US008215036B2

(12) United States Patent
Auger et al.

(10) Patent No.: US 8,215,036 B2
(45) Date of Patent: Jul. 10, 2012

(54) REMOVABLE HEEL BUCKET

(75) Inventors: Perry W. Auger, Tigard, OR (US); Sergio Cavaliere, Venizia (IT); Paul Hooper, Vancouver, WA (US)

(73) Assignee: Nike, Inc., Beaverton, OR (US)

( * ) Notice: Subject to any disclaimer, the term of this patent is extended or adjusted under 35 U.S.C. 154(b) by 448 days.

(21) Appl. No.: 12/488,944

(22) Filed: Jun. 22, 2009

(65) Prior Publication Data

US 2010/0319218 A1 Dec. 23, 2010

(51) Int. Cl.
*A43B 3/26* (2006.01)
*A43B 13/42* (2006.01)

(52) U.S. Cl. ..... 36/69; 36/58.5; 36/92; 36/105

(58) Field of Classification Search ..... 36/68, 69, 36/36 B, 58.5, 58.6, 92, 76 HH, 72 B, 75 R
See application file for complete search history.

(56) References Cited

U.S. PATENT DOCUMENTS

| | | | | |
|---|---|---|---|---|
| 630,726 | A | 8/1899 | Morrow | |
| 1,012,253 | A | 12/1911 | Gerhart | |
| 1,691,582 | A | 11/1928 | Nowak | |
| 1,769,758 | A | 7/1930 | Siese, Jr. | |
| 1,828,246 | A | 10/1931 | Destro | |
| 1,830,912 | A | 11/1931 | Ramey | |
| 1,873,222 | A | 8/1932 | Shaw | |
| 1,895,141 | A | 1/1933 | Watanabe | |
| 1,946,591 | A | 2/1934 | Saito | |
| 2,088,976 | A | 8/1937 | Resnik | |
| 2,562,480 | A | 7/1951 | Stout | |
| 3,112,571 | A * | 12/1963 | Musgrave | 36/70 R |
| 3,239,953 | A | 3/1966 | Norton | |
| 3,248,810 | A * | 5/1966 | Baudou | 36/75 R |
| 3,400,474 | A | 9/1968 | Tendler | |
| 3,810,318 | A * | 5/1974 | Epstein | 36/105 |
| 4,179,826 | A | 12/1979 | Davidson | |
| 4,503,628 | A | 3/1985 | Mancinelli et al. | |
| 4,642,916 | A | 2/1987 | Collins | |
| 4,756,097 | A | 7/1988 | Sanders | |
| D336,558 | S | 6/1993 | Escoffier | |
| 5,738,937 | A | 4/1998 | Baychar | |
| 5,842,292 | A | 12/1998 | Siesel | |
| 6,048,810 | A | 4/2000 | Baychar | |
| 6,442,874 | B1 * | 9/2002 | Long | 36/97 |
| 6,584,707 | B1 * | 7/2003 | Racine et al. | 36/97 |
| 7,168,188 | B2 | 1/2007 | Auger et al. | |
| 7,204,043 | B2 | 4/2007 | Kilgore | |
| 7,293,370 | B2 | 11/2007 | Kaplan et al. | |
| 7,314,840 | B2 | 1/2008 | Baychar | |

FOREIGN PATENT DOCUMENTS

| | | |
|---|---|---|
| DE | 3928625 | 3/1991 |
| GB | 2 215 180 | 9/1989 |
| WO | WO 94/16589 | 8/1994 |

* cited by examiner

*Primary Examiner* — Jila Mohandesi
(74) *Attorney, Agent, or Firm* — Plumsea Law Group, LLC

(57) ABSTRACT

An article of footwear including a sole assembly; an upper attached to the sole assembly; a heel counter on the upper, the heel counter having an upper edge and including a first connector portion that extends along the upper edge; and a heel insert removably attached to the heel counter along its upper edge, the heel insert having a corresponding second connector portion that mates with the first connector portion of the heel counter.

26 Claims, 17 Drawing Sheets

REMOVABLE HEEL BUCKET

BACKGROUND

The present invention relates generally to an article of footwear, and in particular to an article of footwear with a removable heel insert.

Articles of footwear with removable heel buckets or other similar heel inserts that are located in the heel area of a shoe have been proposed. These heel inserts are typically used for improving the fit about a user's heel, reducing movement of the heel in the shoe, and improving overall comfort. Many of the known inserts extend circumferentially around the interior and/or edge of the upper in the heel portion. Some of these inserts use a mechanical connection to secure the inserts to the shoe, while at least one insert is connected to the heel counter in the shoe. Many of the known inserts have some sort of cushioning for customizing the fit of the shoe or for comfort. For example, Resnick (U.S. Pat. No. 2,088,976) is directed to a heel insert with a top portion that is rolled outwardly over the top edge of the quarter portion to form a channel of varying width which uses pressure to grip the edge of the shoe adjacent the front ends of the insert. Since the channel is wider at the rear and gradually narrows toward the front, pressure is only applied to the front edges of the shoe where the channel has narrowed to secure the insert to the shoe. Likewise, Auger et al. (U.S. Pat. No. 7,168,188 B2) is directed to a heel insert that is positioned entirely within the upper and against an interior surface of the heel counter. Projections are located on an inner surface of the heel insert where they snap into apertures on an inner surface of the heel counter. The heel insert may include varying amounts of cushioning.

SUMMARY

The invention discloses a removable heel bucket for an article of footwear. In one aspect, the invention provides an article of footwear comprising: a sole assembly; an upper attached to the sole assembly; a heel counter on the upper, the heel counter having an upper edge and including a first connector portion that extends along the upper edge; and a heel insert removably attached to the heel counter along its upper edge, the heel insert having a corresponding second connector portion that mates with the first connector portion of the heel counter.

In another aspect, the invention provides an article of footwear comprising: a sole assembly; an upper attached to the sole assembly, the upper including a heel engaging component with a first upper edge; a first connector portion integrally formed with the heel engaging component and extending circumferentially along the first upper edge; an insert member removably attached to the heel engaging component along its first upper edge, wherein the insert member includes a second connector portion and a second upper edge; and wherein the second connector portion extends circumferentially along the second upper edge of the insert member and corresponds with the first connector portion so that the insert member is attached to the heel engaging component of the upper along at least a portion of its circumferential length.

In another aspect, the invention provides an article of footwear having a heel insert assembly, the heel insert assembly comprising: a sole assembly; an upper attached to the sole assembly; a heel counter secured to the upper, the heel counter having an upper edge and including a first connector portion integrally formed therewith and extending circumferentially along the upper edge; a heel insert removably attached to the heel counter along its upper edge, the heel insert including a corresponding second connector portion and a cushioning material that is disposed over and around at least the second connector portion; and wherein the second connector portion mates and extends circumferentially with the first connector portion so that the heel insert is attached to the upper along its entire circumferential length.

Other systems, methods, features and advantages of the invention will be, or will become apparent to one with sill in the art upon examination of the following figures and detailed description. It is intended that all such additional systems, methods, features and advantages be included within this description, be within the scope of this invention, and be protected by the following claims.

BRIEF DESCRIPTION OF THE DRAWINGS

The invention may be better understood with reference to the following figures and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
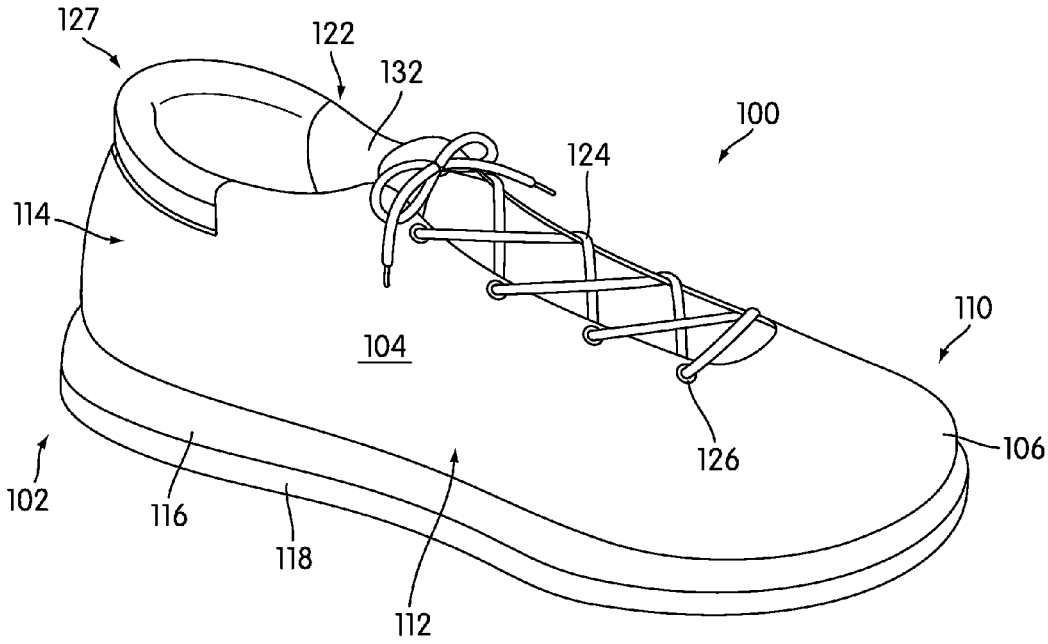
FIG. 1 is an isometric view of an embodiment of an article of footwear.

FIG. 1 is an isometric view of one embodiment of an article of footwear 100. In this embodiment, article of footwear 100 may be a running shoe. For clarity, the following detailed description discusses a preferred embodiment. However, it should be kept in mind that the present invention could also take the form of any other kind of footwear including, for example, any type of athletic shoes, boots, as well as other kinds of footwear. As shown throughout the figures, article of footwear 100 is intended to be used with a right foot. However, it should be understood that the following discussion may equally apply to a mirror image of article of footwear 100 that is intended for use with a left foot.

Article of footwear 100 is depicted in FIGS. 1-4 as including a sole structure 102 and an upper 104. For reference purposes, footwear 100 includes a lateral side 106 and a medial side 108 and may be divided into three general regions: a forefoot region 110, a midfoot region 112, and a heel region 114, as shown in FIGS. 1-4. Forefoot region 110 generally includes portions of footwear 100 corresponding with the toes and the joints connecting the metatarsals with the phalanges. Midfoot region 112 generally includes portions of footwear 100 corresponding with the arch area of the foot, and heel region 114 corresponds with rear portions of the foot, including the calcaneus bone. Lateral side 106 and medial side 108 extend through each of regions 110, 112,114 and correspond with opposite sides of footwear 100. Regions 110, 112, 114 and sides 106, 108 are not intended to demarcate precise areas of footwear 100. Rather, regions 110, 112, 114 and sides 106, 108 are intended to represent general areas of footwear 100 to aid in the following discussion. In addition to footwear 100, regions 110, 112, 114 and sides 106, 108 may also be applied to sole structure 102, upper 104, and individual elements thereof.

Figure 4:
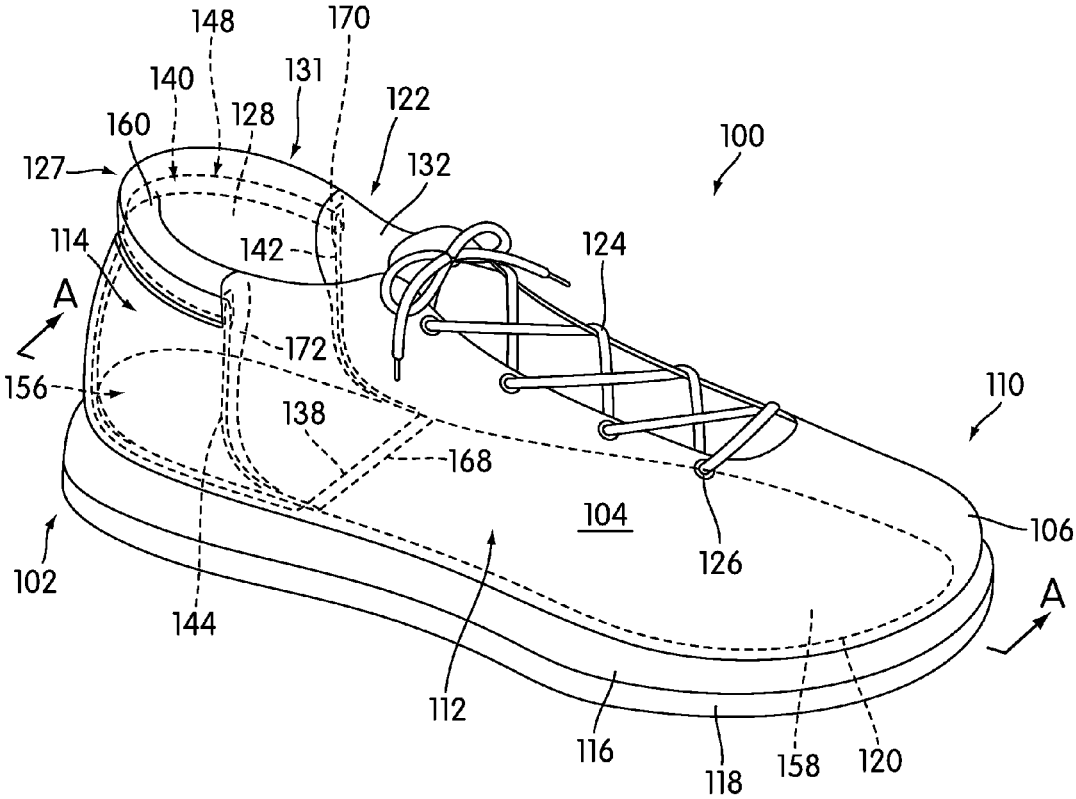
FIG. 4 is an isometric view of an article of footwear, illustrating another embodiment of a heel bucket insert positioned within the upper.

Sole structure 102 is secured to upper 104 and extends between the foot and the ground when footwear 100 is worn. The primary elements of sole structure 102 are a midsole 116, an outsole 118, and a sockliner or insole 120 (FIG. 4). Midsole 116 is secured to a lower surface of upper 104 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, midsole 116 may incorporate fluid-filled chambers, plates, moderators, or other elements that further attenuate forces, enhance stability, or influence the motions of the foot, or midsole 116 may be primarily formed from a fluid-filled chamber. Outsole 118 is secured to a lower surface of midsole 116 and may be formed from a wear-resistant rubber material that is textured to impart traction. Insole 120 is located within upper 104 and is positioned to extend under a lower surface of the foot. Although this configuration for sole structure 102 provides an example of a sole structure that may be used in connection with upper 104, a variety of other conventional or nonconventional configurations for sole structure 102 may also be utilized. Accordingly, the structure and features of sole structure 102 or any sole structure utilized with upper 104 may vary considerably.

Figure 2:
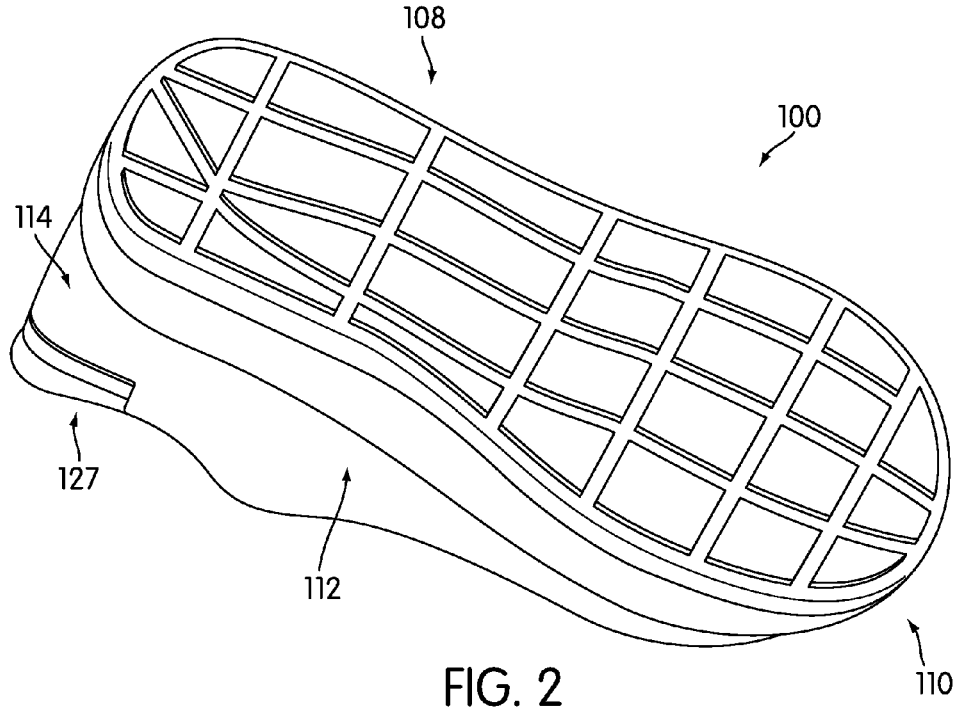
FIG. 2 is an upside down view of an embodiment of an article of footwear.

Referring to FIGS. 1-2, upper 104 defines a void within footwear 100 for receiving and securing a foot relative to sole structure 102. The void is shaped to accommodate the foot and extends along the lateral side of the foot, along the medial side of the foot, over the foot, around the heel, and under the foot. Access to the void is provided by an ankle opening 122 located in at least heel region 114. A lace 124 extends through various lace apertures 126 and permits the wearer to modify dimensions of upper 104 to accommodate the proportions of the foot. More particularly, lace 124 permits the wearer to tighten upper 104 around the foot, and lace 124 permits the wearer to loosen upper 104 to facilitate entry and removal of the foot from the void (i.e., through ankle opening 122). In addition, upper 104 may include a tongue (not depicted in figures) that extends under lace 124. The various portions of upper 104 may be formed from one or more of a plurality of material elements (e.g., textiles, polymer sheets, foam layers, leather, synthetic leather) that are stitched or bonded together to form the void within footwear 100.

Figure 3:
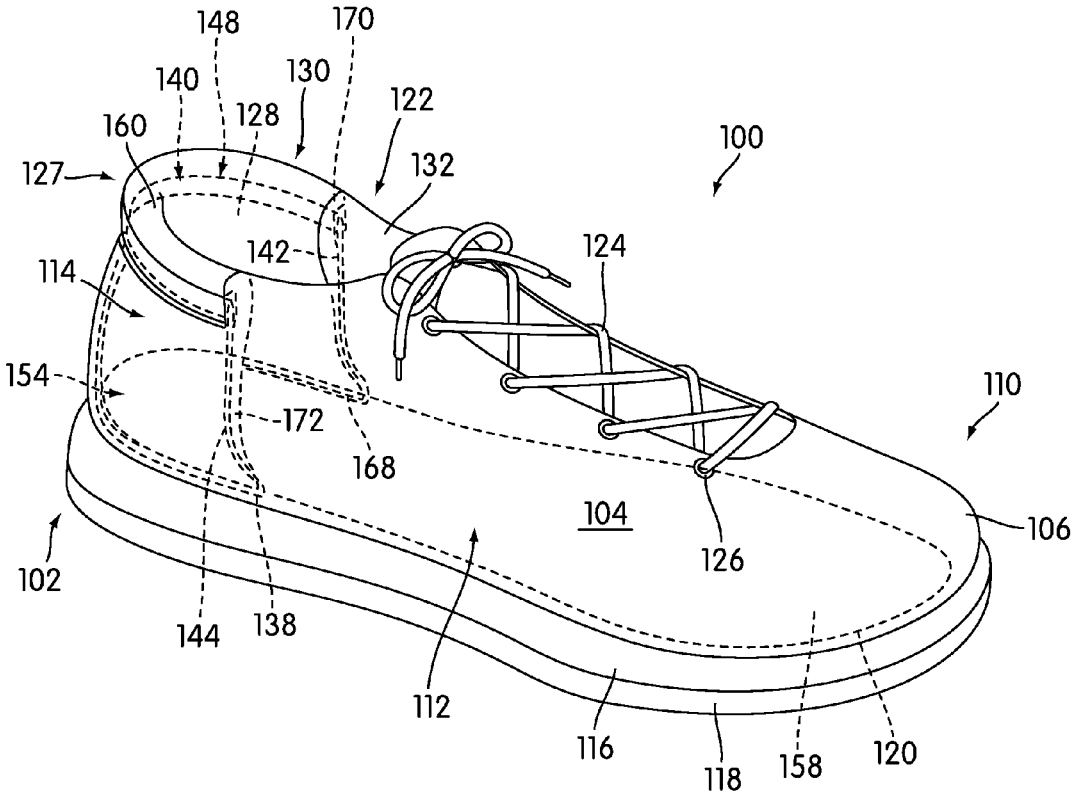
FIG. 3 is an isometric view of an article of footwear, illustrating an embodiment of a u-shaped heel insert positioned within the upper.

Upper 104 may also incorporate a variety of support, stabilizing and cushioning elements, alone or in combination, including but not limited to, a heel insert assembly 127 that includes a heel counter 128 for providing support and limiting heel movement in heel region 114 and a heel insert 130, 131 for improving comfort and achieving a customized fit for the user (FIGS. 3-4). In one embodiment, heel counter 128 of heel insert assembly 127 conforms with and engages an inner surface 132 of upper 104 in heel region 114. Heel counter 128 may be secured to upper 104 with an adhesive, such as cement, or by any other suitable material or attachment means. Heel insert 130, 131 of heel insert assembly 127 may then be removably attached to heel counter 128, as is discussed in greater detail below.

Figure 5:
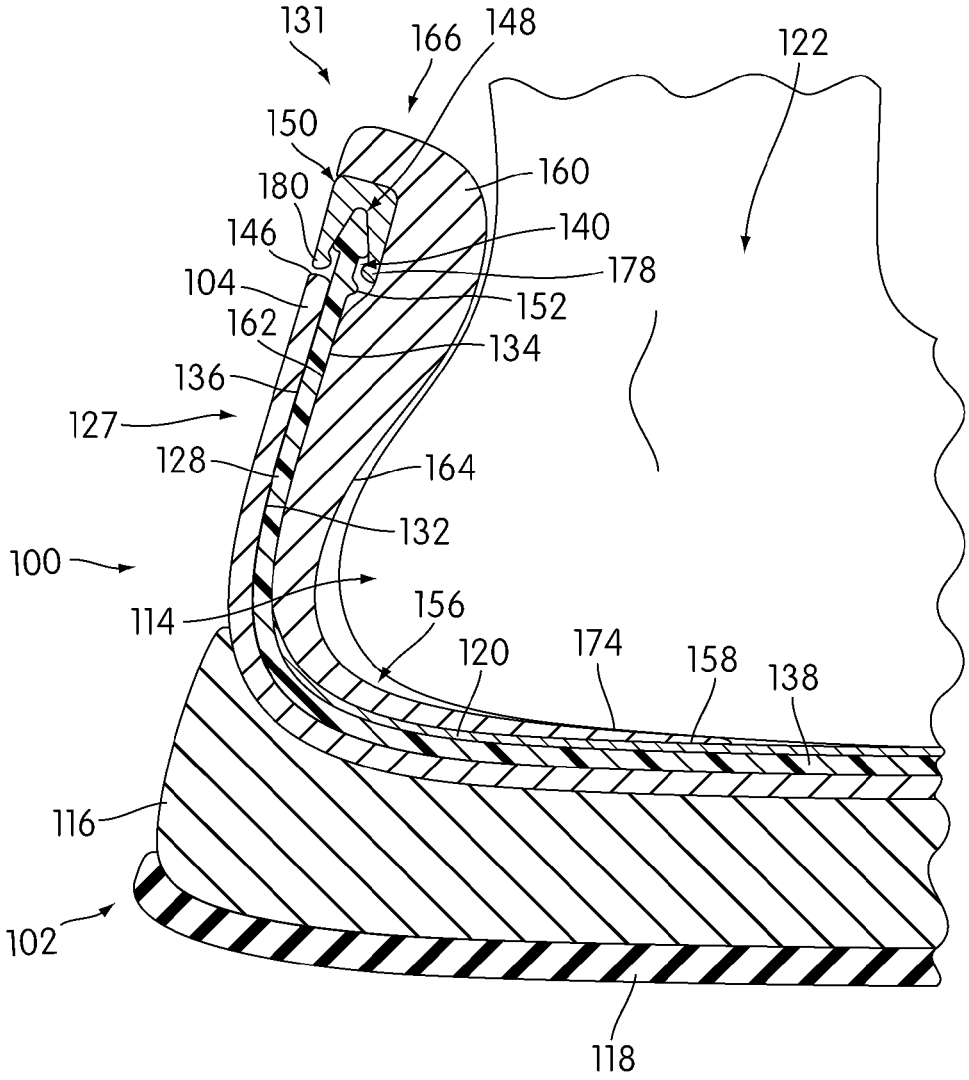
FIG. 5 is a partial cross-sectional view of an embodiment of a heel insert, taken along lines A-A of FIG. 1.
Figure 6:
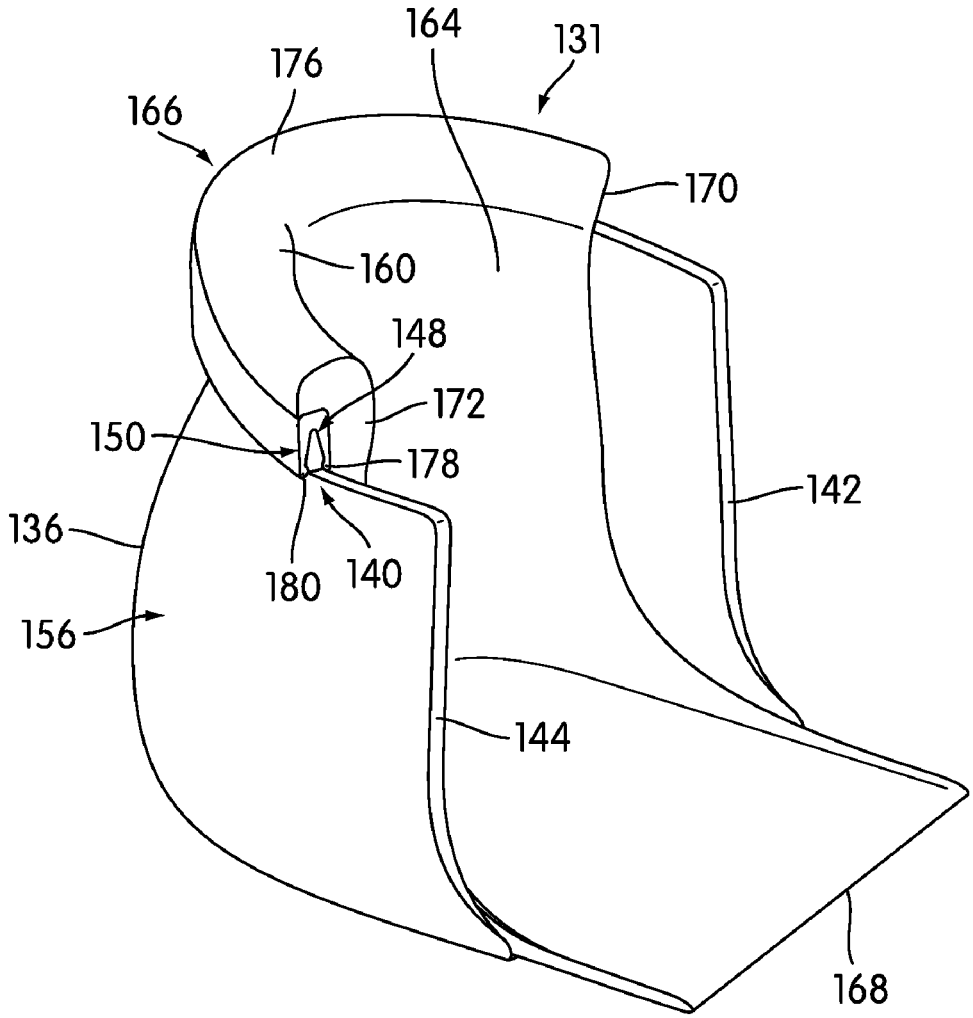
FIG. 6 is a perspective view of an embodiment of a heel insert assembly, illustrating a heel insert as it would appear attached to a heel counter.

Referring first to FIGS. 3-5, heel counter 128 of heel insert assembly 127 may include an inner surface 134, an outer surface 136, a lower edge 138, an upper edge 140, and sides 142, 144. Lower edge 138 of heel counter 128 may be adjacent to (FIG. 3) or disposed on and flush with a portion of insole 120 (FIG. 4), while sides 142, 144 may extend along inner surface 132 of upper 104 in heel region 114 towards midfoot region 112 of footwear 100. Upper edge 140 of heel counter 128 is generally flush with a top edge 146 of upper 104 and may include an integrally formed first connector portion 148 that projects above and extends circumferentially along a portion of the circumferential length of upper edge 140 (FIG. 6) or along the entire circumferential length of upper edge 140 (FIGS. 3-4). First connector portion 148 may embody any type of mechanical connector but is preferably a mechanical snap fit connector and, more particularly, the male portion of a snap fit connector that protrudes from and extends along the edge of heel counter 128. In addition, first connector portion 148 may be configured to engage a corresponding second connector portion 150 which is disposed on heel inserts 130, 131, as is discussed in greater detail below.

In other embodiments, heel counter 128 may be integrally formed with upper 104 (not depicted in figures). The top edge of the integrally formed heel counter/upper may also include a first connector portion that extends circumferentially along a portion of the top edge or the entire circumferential length of the top edge. This embodiment is similar to the previously described embodiments in that the first connector portion further corresponds to and mates with the second connector portion of the heel insert.

Figure 7:
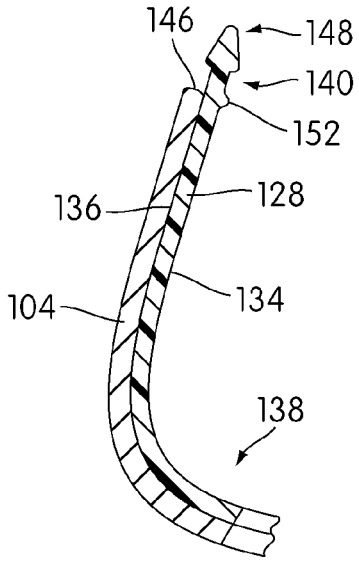
FIG. 7 is a cross-sectional view of an embodiment of a heel counter.
Figure 8:
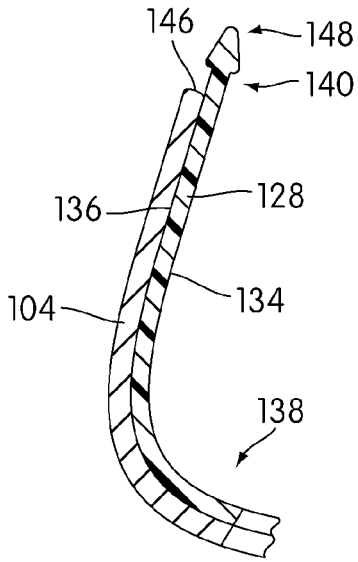
FIG. 8 is a cross-sectional view of another embodiment of a heel counter.

In another embodiment, heel counter 128 may include an integrally formed and circumferentially extending protuberance 152 on inner surface 134 adjacent to and beneath first connector portion 148 (FIG. 7). Protuberance 152 may increase the rigidity of heel counter 128 adjacent first connector portion 148 and further may securely position heel counter 128 against second connector portion 150 of heel inserts 130, 131 (FIG. 5). In another embodiment, inner surface 134 of heel counter 128 is substantially smooth (see FIG. 8).

Heel counter 128 and first connector portion 148 may be formed of any substantially rigid material, such as thermoplastic polyurethane, nylon, or any other suitable semi-rigid material.

Figure 9:
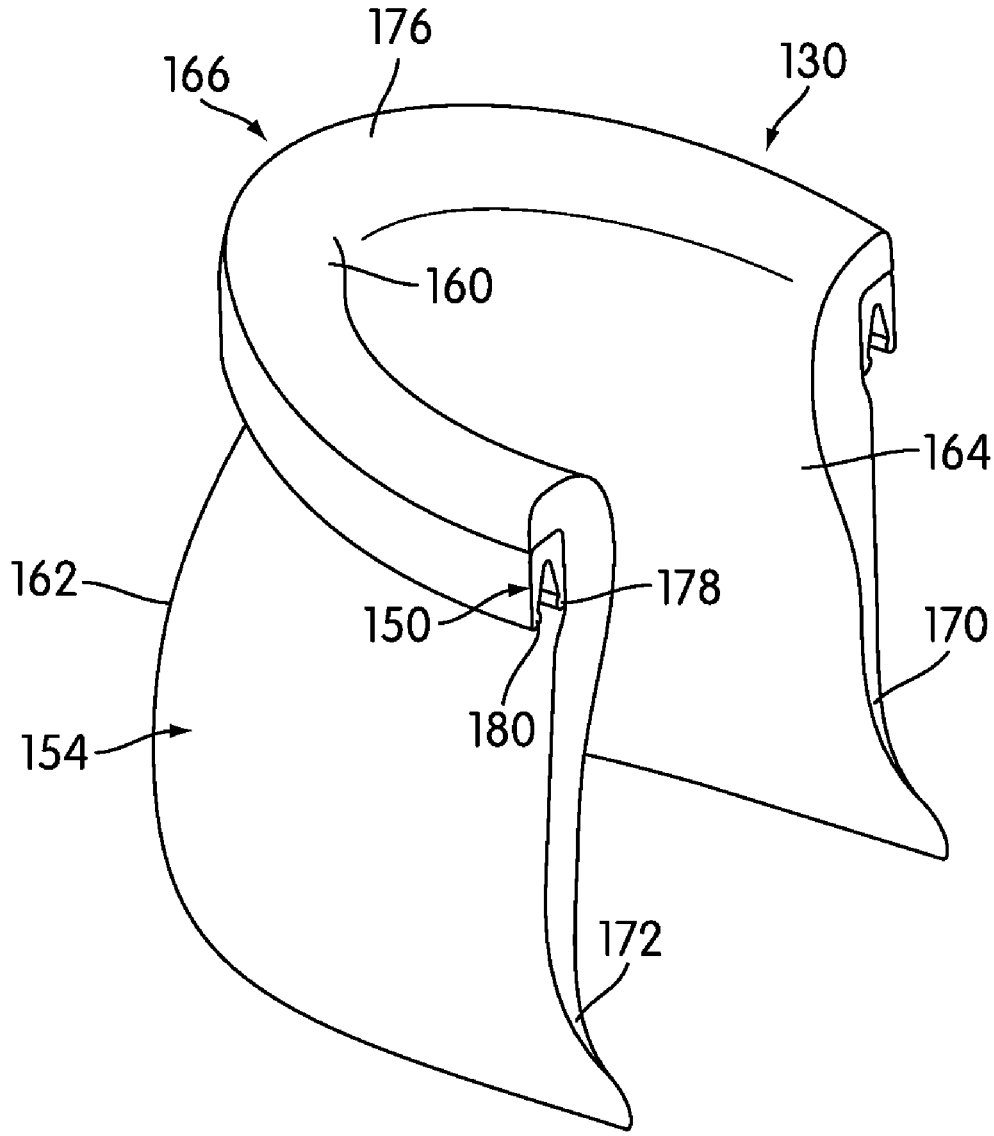
FIG. 9 is a perspective view of an embodiment of a u-shaped heel insert.
Figure 10:
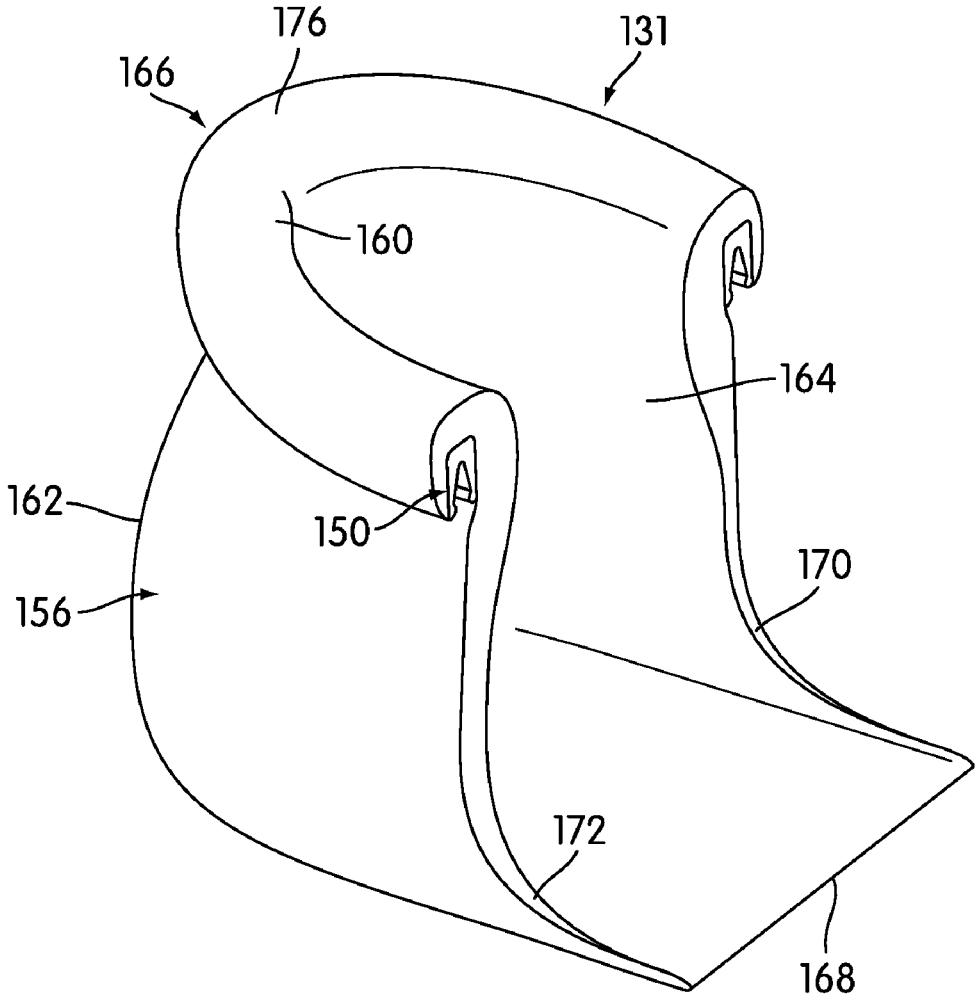
FIG. 10 is a perspective view of an embodiment of a heel bucket insert.
Figure 11:
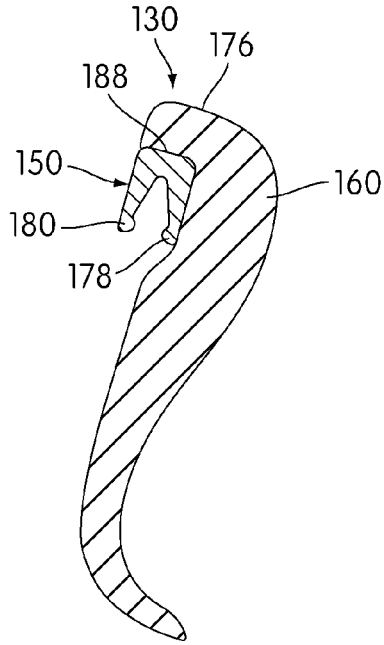
FIG. 11 is a cross-sectional view of an embodiment of a u-shaped heel insert.
Figure 12:
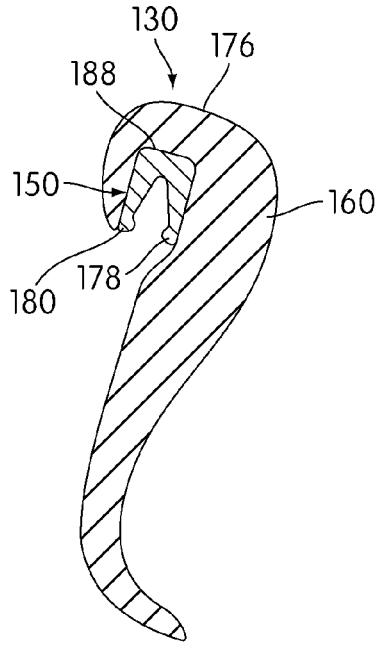
FIG. 12 is a cross-sectional view of another embodiment of a u-shaped heel insert.
Figure 13:
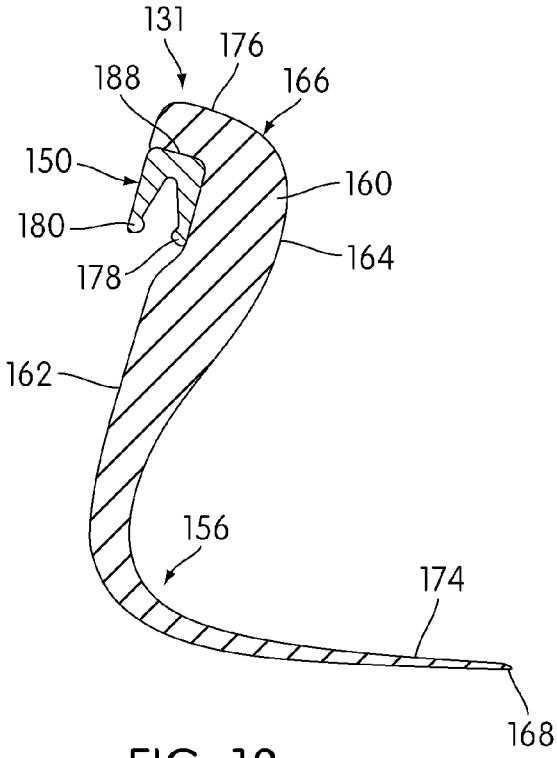
FIG. 13 is a cross-sectional view of an embodiment of a heel bucket insert.
Figure 14:
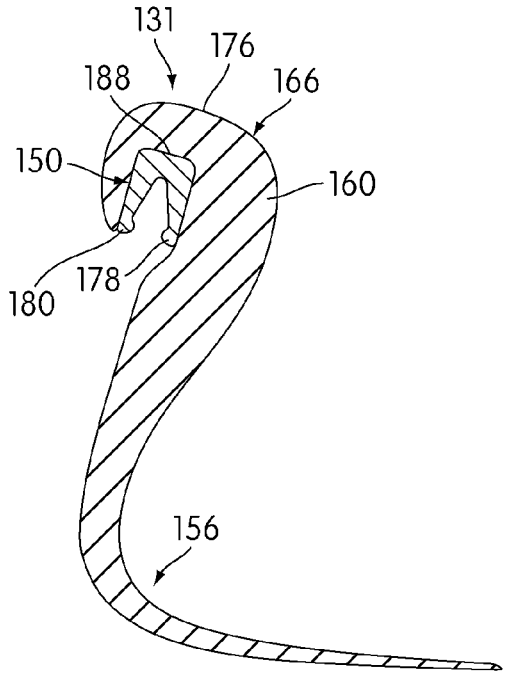
FIG. 14 is cross-sectional view of another embodiment of a heel bucket insert.

In some of the embodiments and referring to FIGS. 3-4, heel inserts 130, 131 of heel insert assembly 127 may be removably attached to and positioned within upper 104 such that both heel inserts 130, 131 wrap around at least a portion of the user's heel. In one embodiment, heel insert 130 is generally u-shaped and forms a collar (hereinafter referred to as u-shaped heel insert 154) that is flush with inner surface 134 of heel counter 128 and which is contoured to wrap around the sides of the user's heel (FIGS. 3 and 9). In another embodiment, heel insert 131 is generally configured as a heel bucket (hereinafter referred to as heel bucket insert 156) which is flush with and conforms to both inner surface 134 of heel counter 128 and an upper surface 158 of insole 120 (FIGS. 4 and 10). In the latter embodiment, heel bucket insert 156 not only wraps around the sides of the user's heel but it extends beneath and captures the heel of the user.

In any of the embodiments, heel inserts 130, 131 include a cushioning member 160 for customizing the fit of footwear 100 and/or for improving overall footwear comfort. Cushioning member 160 is generally formed over and around at least part of second connector portion 150 and extends into heel region 114 of upper 104. Cushioning member 160 includes an outer surface 162, an inner surface 164, an upper edge 166, a lower edge 168, and sides 170, 172. Cushioning member 160 of u-shaped heel insert 154 may be vertically disposed within heel region 114 such that outer surface 162 of cushioning member 160 abuts against and generally conforms to the contours of inner surface 134 of heel counter 128 (FIG. 3). Likewise, cushioning member 160 of heel bucket insert 156 may be vertically disposed within heel region 114 but additionally may include a generally contoured and integrally formed horizontal component in the form of a heel bucket or cup 174 that is flush with a lower heel engaging area on upper surface 158 of insole 120 (FIGS. 4-5). Moreover, cushioning member 160 may have varying thicknesses so that different heel inserts 130, 131 are configured with different foam contours.

Sides 170, 172 of cushioning member 160 of heel inserts 130, 131 are generally aligned with sides 142, 144 of heel counter 128 and may extend approximately 180 degrees around inner surface 132 of upper 104 in heel region 114 (FIGS. 3-4). However, in some embodiments, sides 170, 172 may be positioned adjacent to and inwardly from sides 142, 144 of heel counter 128 (FIG. 6) or may extend past sides 142, 144 of heel counter 128 and along inner surface 132 of upper 104 towards midfoot region 112 of footwear 100 (FIG. 4). Thus, in various instances, sides 170, 172 of cushioning member 160 of heel inserts 130, 131 may extend more or less than 180 degrees around heel region 114 of upper 104.

In one embodiment of u-shaped heel insert 154, lower edge 168 of cushioning member 160 may coincide with lower edge 138 of heel counter 128 (not depicted in figures) or may be disposed inwardly from lower edge 138 of heel counter 128 on upper surface 158 of insole 120 and in close proximity to inner surface 132 of upper 104 (FIG. 3). In another embodiment of heel bucket insert 156, cushioning member 160 may generally align with or extend beyond lower edge 138 of heel counter 128 and onto upper surface 158 of insole 120 (FIG. 4).

Figure 15:
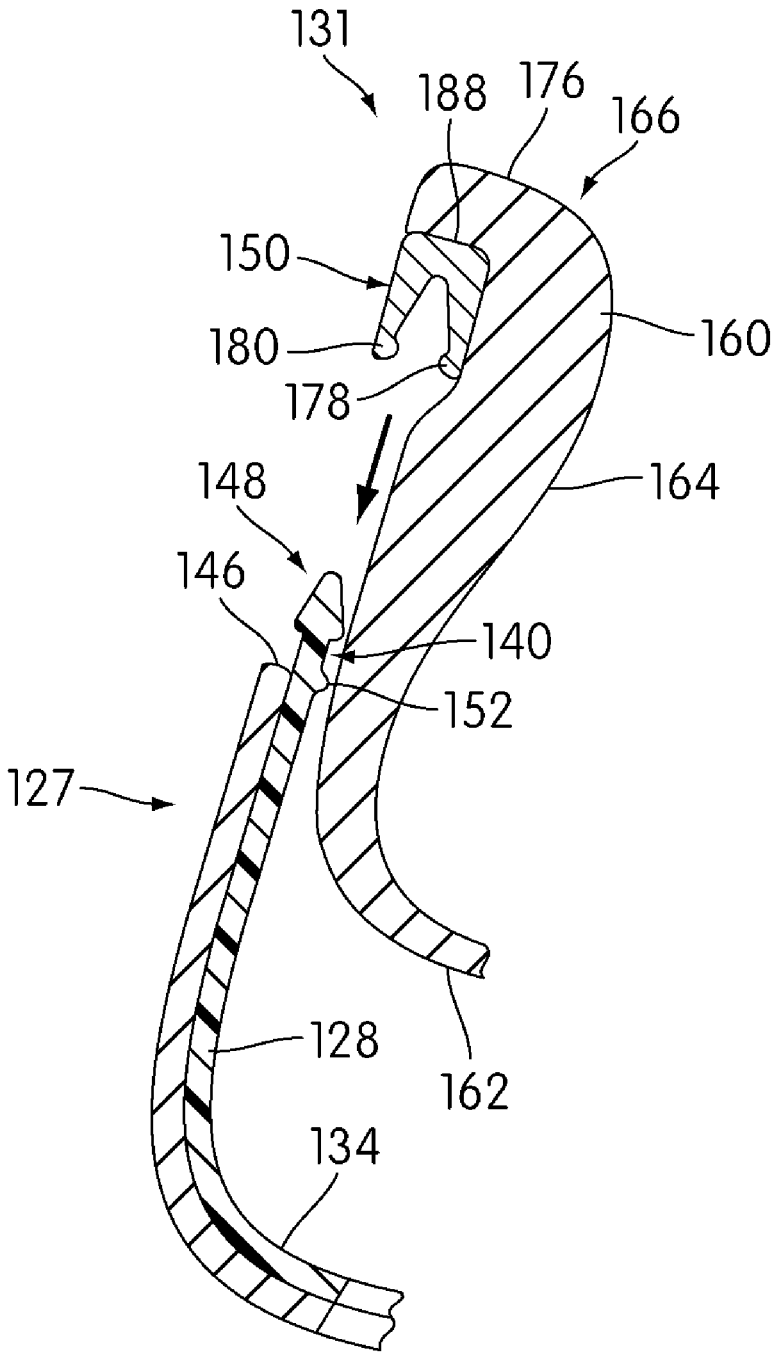
FIG. 15 is a partial schematic cross-sectional view of an embodiment of a heel insert assembly, illustrating the insertion of a heel insert onto a heel counter.
Figure 16:
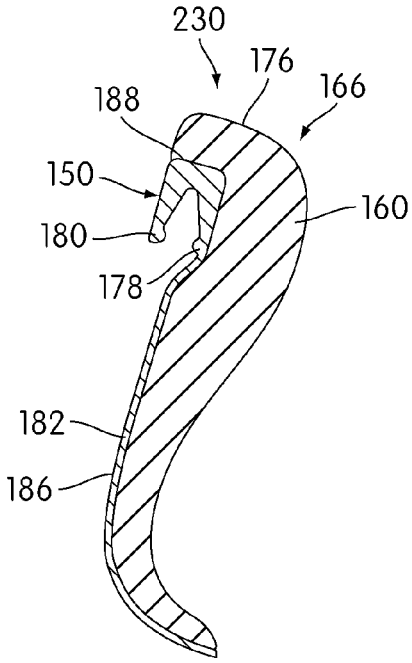
FIG. 16 is a cross-sectional view of an embodiment of a u-shaped heel insert.
Figure 17:
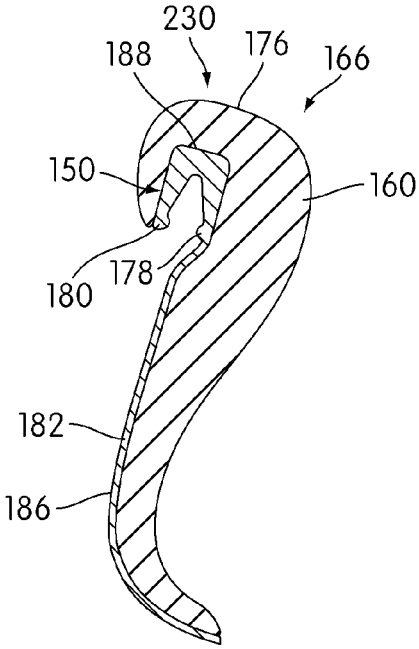
FIG. 17 is a cross-sectional view of another embodiment of a u-shaped heel insert.

In any of the aforementioned embodiments, upper edge 166 of cushioning member 160 of heel inserts 130, 131 may include second connector portion 150 which is disposed adjacent and beneath a top most part 176 of cushioning member 160 (FIGS. 11-14). Second connector portion 150 may extend circumferentially along a portion of heel inserts 130, 131 adjacent to top most part 176 of cushioning member 160 (FIG. 6) or may extend circumferentially along the entire portion of heel inserts 130, 131 adjacent to top most part 176 of cushioning member 160 (FIGS. 3-4). In one embodiment, the circumferential length of second connector portion 150 generally corresponds to the circumferential length of first connector portion 148 (see FIGS. 3-4). However, in another embodiment, the circumferential lengths of the connector portions may differ from one another (not depicted in figures) . Second connector portion 150 may embody any type of mechanical connector but is preferably a mechanical snap fit connector and, more particularly, the female portion of a snap fit connector. Second connector portion 150 includes an inner resilient member 178 and an outer resilient member 180 that may be configured to engage the corresponding and protruding male portion of first connector portion 148 (FIG. 15), as is discussed in greater detail below.

Referring to FIGS. 16-20, in other embodiments, inner resilient member 178 of second connector portion 150 may extend downwardly to form a generally vertical member 182 (FIGS. 16-17) or a contoured member 184 (FIGS. 18-19) which may serve as the outer surface of heel inserts 230 and 231, respectively. In these embodiments, vertical member 182 and contoured member 184 may include an outer surface 186 which abuts against and generally conforms to the contours of inner surface 134 of heel counter 128. Vertical and contoured members, 182 and 184, respectively, provide rigidity to heel inserts 230 and 231 and further provide a surface onto which different foam bucket contours may be formed (discussed below).

Figure 21:
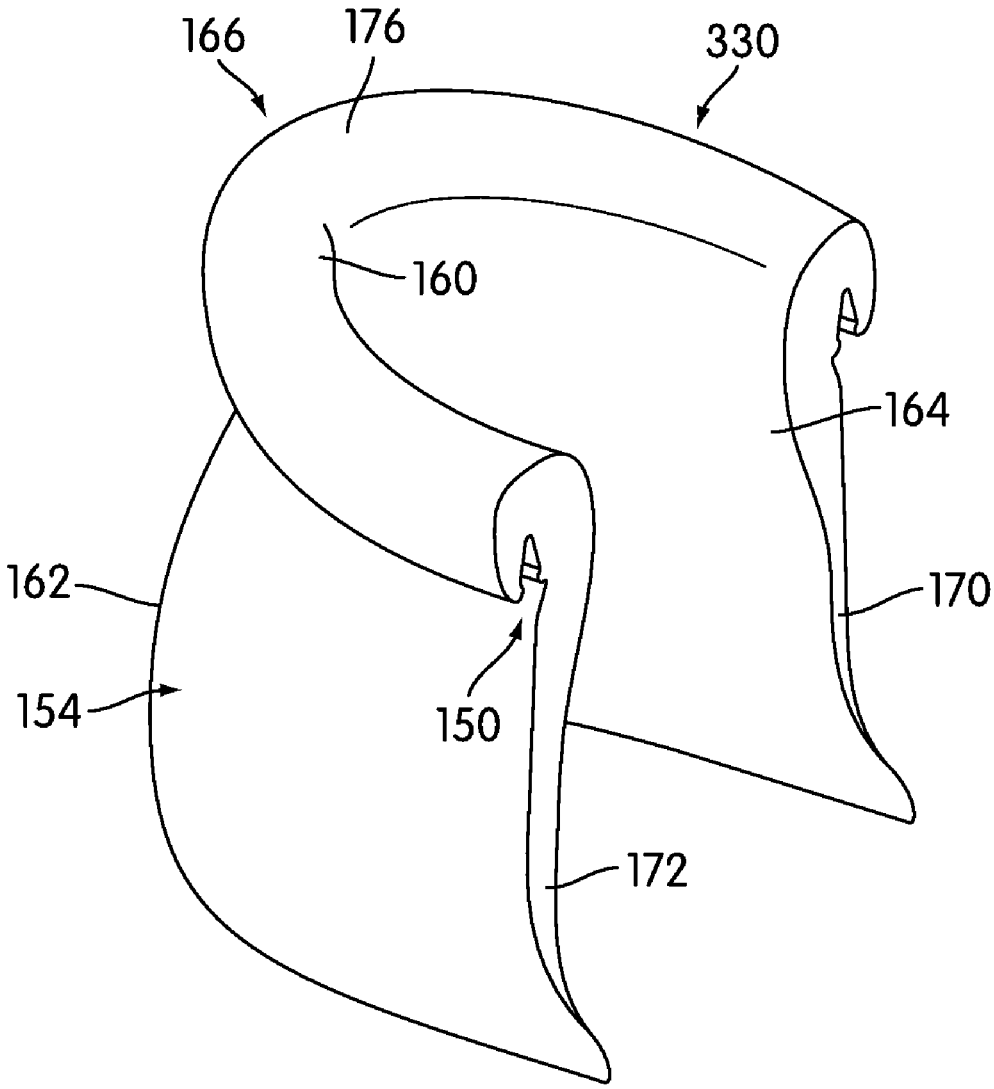
FIG. 21 is a perspective view of another embodiment of a u-shaped heel insert.
Figure 22:
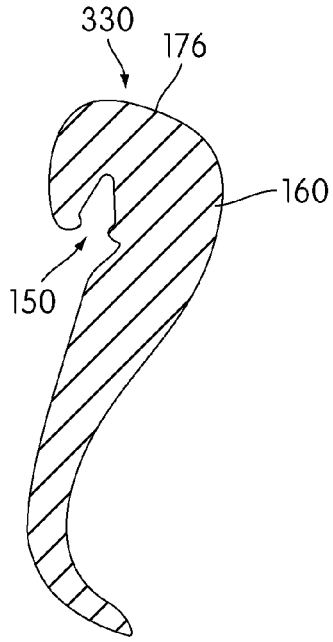
FIG. 22 is a cross-sectional view of another embodiment of a u-shaped heel insert.
Figure 23:
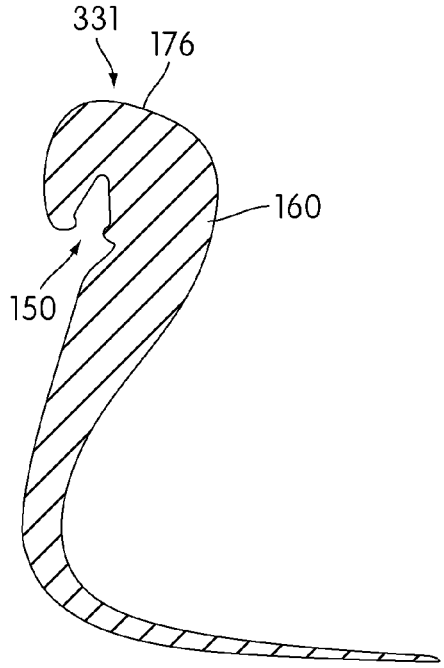
FIG. 23 is a cross-sectional view of yet another embodiment of a heel bucket insert.

Referring to FIGS. 21-23, in some embodiments, second connector portion 150 is integrally formed within heel inserts 330, 331. In this instance, second connector portion 150 is integrally formed beneath top most part 176 of cushioning member 160 and may be configured to engage the corresponding and protruding male portion of first connector portion 148 that is disposed on heel counter 128. Specifically, cushioning member 160 may be configured beneath top most part 176 to form the inner and outer resilient members of the female connecting portion which may receive and retain the male portion of first connector portion 148. In an alternate embodiment, the male portion of the snap fit connector may be integrally formed beneath top most part 176 of cushioning member 160 and upper edge 166 of heel inserts 330, 331 may similarly be configured with the corresponding female portion of the snap fit connector (not depicted in figures).

As previously discussed, cushioning member 160 of the heel insert in any of the embodiments is generally formed over and around at least part of second connector portion 150. In one embodiment, cushioning member 160 may be formed over inner resilient member 178 and a top surface 188 of second connector portion 150 (FIGS. 11, 13, 16, 18). In another embodiment, cushioning member 160 may further wrap around and be formed on outer resilient member 180 of second connector portion 150 (FIGS. 12, 14, 17, 19). In any of the embodiments, cushioning member 160 may extend downwardly from second connector portion 150 and into heel region 114 to form the cushioned u-shaped heel insert 154 (FIGS. 3, 9) or the cushioned heel bucket insert 156 (FIGS. 4-5). Alternatively, cushioning member 160 may be disposed adjacent second connector portion 150 to form a circumferentially extending cushioned collar which is disposed only within upper portion of heel region 114 (not depicted in figures).

In the embodiments discussed above in which cushioning member 160 forms u-shaped heel insert 154 and heel bucket insert 156, outer surface 162 of cushioning member 160 which abuts against inner surface 134 of heel counter 128 may be formed of a thicker or more dense material to provide additional support to the insert. Similarly, inner surface 164 of cushioning member 160 may be formed with a softer material to provide additional comfort to the user.

Figure 18:
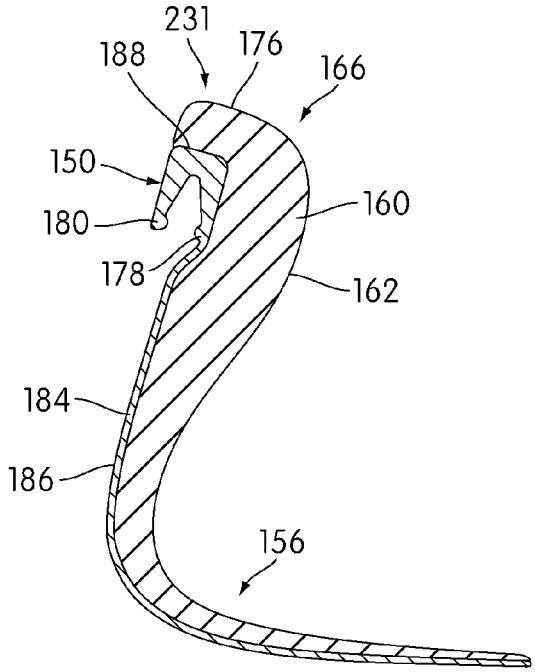
FIG. 18 is a cross-sectional view of yet another embodiment of a heel bucket insert.
Figure 19:
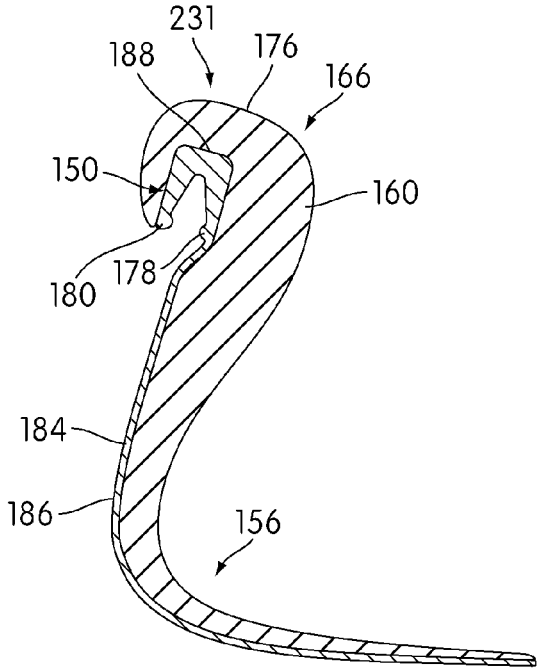
FIG. 19 is a cross-sectional view of another embodiment of a heel bucket insert.
Figure 20:
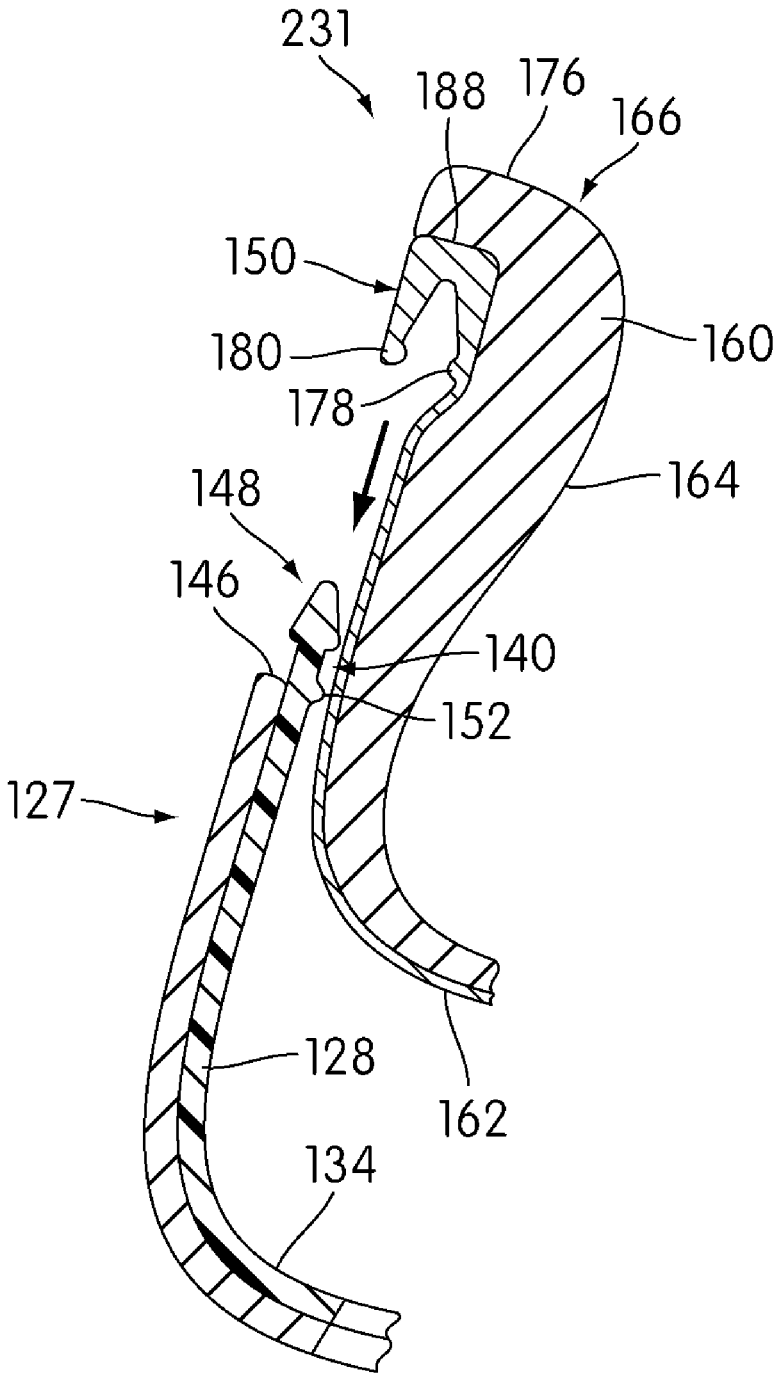
FIG. 20 is a partial schematic cross-sectional view of another embodiment of a heel insert assembly, illustrating the insertion of a heel insert onto a heel counter.

In other embodiments, cushioning member 160 may be formed over and in flush relationship with vertical member 182 (FIGS. 16-17) or contoured member 184 (FIGS. 18-19). As in previous embodiments, outer surface 162 of cushioning member 160 may be formed with any desired contour or thickness.

Second connector portion 150, vertical member 182 and contoured member 184 may be formed of any substantially rigid material, such as thermoplastic polyurethane, nylon, or any other suitable semi-rigid material. The heel inserts in any of the aforementioned embodiments, including u-shaped heel insert 154 and heel bucket insert 160, may be made from any suitable material including, but not limited to, bucket foam, a thermoformed ethylene vinyl acetate (EVA) foam, or a poured polyurethane foam.

Figure 24:
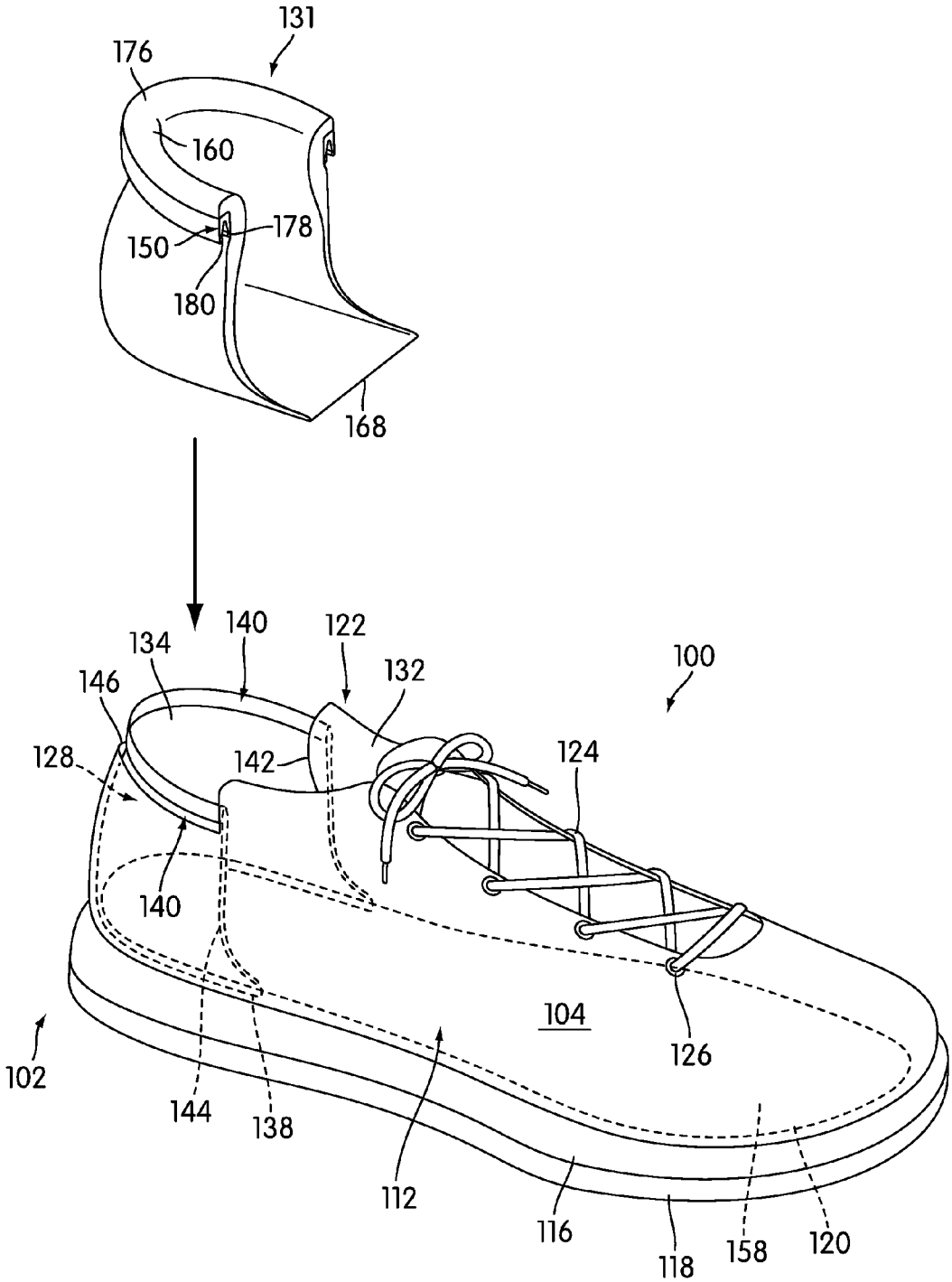
FIG. 24 is an isometric view of an article of footwear, illustrating one embodiment of a heel insert being inserted into and positioned within the upper.

In use, footwear 100 may be provided with a heel insert assembly 127 that includes a heel insert 130, 131 (or any other of the aforementioned embodiments) that may be quickly and easily inserted through ankle opening 122 and into heel region 114 (FIG. 24). Since the heel insert in heel insert assembly 127 has various embodiments, a user may select from different heel insert configurations, depending on the conditions or requirements of the user at a given time. For example, the shape and size of the heel insert and/or the amount and thickness of the cushioning member may vary between different inserts. Thus, the exact configuration of the heel insert that is inserted into ankle opening 122 may depend on the specific requirements of a user, at any given time, in terms of size, fit, performance and functionality.

Once the desired heel insert configuration has been chosen by the user, the heel insert is ready for insertion into footwear 100. This involves positioning the heel insert within ankle opening 122 of heel region 114 so that cushioning member 160 is disposed within heel region 114 and second connector portion 150 is aligned with and engages first connector portion 148 of heel counter 128 in a snap-fit fashion, as indicated by the arrows in FIG. 24. Specifically, the protruding male portion of first connector portion 148 is inserted between and pushed between and into the void formed by inner and outer resilient members, 178 and 180, respectively, of second connector portion 150, as indicated by the arrows in FIGS. 15 and 20. The protruding male portion preferably extends completely into second connector portion 150 until it engages an upper, inner surface 190 within the void of second connector portion 150 or until protuberance 152 on inner surface 134 of heel counter 128 abuts against a lower edge 192 of inner resilient member 178 (FIG. 5).

Once the first and second connector portions have been forcibly snapped together, the connector portions extend circumferentially with one another so that the heel insert is attached to upper 104 along a part of or its entire circumferential length. Moreover, the snap-fit connection between the first and second connector portions causes the contoured outer surface 162 of cushioning member 160 of the heel insert to engage in flush relationship with the contours of inner surface 134 of heel counter 128 and, in some embodiments, upper surface 158 of insole 120. It is this snap-fit connection between first and second connectors, 148 and 150, respectively, that ensures that the heel insert is securely attached to upper 104 along a part of or the entire circumferential length of the upper and is furthermore positioned within heel region 114.

Removal of the heel insert from upper 104 involves applying upward pressure to the insert which causes the protruding male portion of the first connector portion to disengage from the inner and outer resilient members of the second connector portion which, in turn, disengages and releases the heel insert from the upper.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modification and changes may be made within the scope of the attached claims.

What is claimed is:

1. An article of footwear comprising:

a sole assembly;

an upper attached to the sole assembly defining a void for receiving a foot;

a heel counter on the upper, the heel counter having an upper edge and including a first connector portion that extends along the upper edge which is an uppermost edge of the heel counter, wherein the heel counter is located inside the upper;

wherein the first connector portion is a male mechanical connector; and a heel insert removably attached to the heel counter along its upper edge, the heel insert having a corresponding second connector portion that is a female mechanical connector having portions that mate with the male mechanical connector of the heel counter by engaging both an inside surface and an outside surface of the male connector;

wherein the inside surface faces the void and wherein the outside surface faces away from the void.

2. The article of footwear of claim 1 wherein the male connector and the female connector extend circumferentially with one another so that the heel insert is attached to the upper along an entire circumferential length of the heel insert.

3. The article of footwear of claim 1 wherein the first connector portion is integrally formed with the heel counter.

4. The article of footwear of claim 1 wherein the second connector portion is integrally formed with the heel insert.

5. The article of footwear of claim 1 wherein the male connector extends circumferentially along the upper edge of the heel counter.

6. The article of footwear of claim 1 wherein the male connector extends circumferentially adjacent to an upper edge of the heel insert.

7. The article of footwear of claim 1 wherein the heel insert includes a cushioning material that is disposed over and around at least the second connector portion.

8. The article of footwear of claim 7 wherein the cushioning material varies in thickness.

9. An article of footwear comprising:

a sole assembly;

an upper attached to the sole assembly;

a heel counter on the upper, the heel counter having an upper edge and including a first connector portion that extends along the upper edge; and a heel insert removably attached to the heel counter along its upper edge, the heel insert having a corresponding second connector portion that mates with the first connector portion of the heel counter;

wherein the heel insert includes a cushioning material that is disposed over and around at least the second connector portion;

wherein the cushioning material further extends downwardly from the second connector portion and into a void defined by the upper where it is disposed in flush relationship with an inner surface of the heel counter.

10. The article of footwear of claim 9 wherein the cushioning material forms a u-shaped collar.

11. The article of footwear of claim 7 wherein the cushioning material further extends downwardly from the second connector portion, over an inner surface of the heel counter, and onto a lower heel engaging area on an upper surface of the sole assembly.

12. The article of footwear of claim 11 wherein the cushioning material forms a heel bucket.

13. An article of footwear comprising:

a sole assembly;

an upper attached to the sole assembly defining a void for receiving a foot, the upper including a heel engaging component with a first upper edge located at an uppermost edge of the upper, wherein the heel engaging component is located within the upper;

a first connector portion that is one of a male mechanical connector and a female mechanical connector integrally formed with the heel engaging component and extending circumferentially along the first upper edge;

an insert member removably attached to the heel engaging component along its first upper edge, wherein the insert member includes a second connector portion that is an other of the male mechanical connector and the female mechanical connector and a second upper edge;

wherein the female mechanical connector includes portions that mate with the male mechanical connector by engaging both an inside surface of the male connector facing the void and an outside surface of the male connector facing the void; and wherein the second connector portion extends circumferentially along the second upper edge of the insert member and corresponds with the first connector portion so that the insert member is attached to the heel engaging component of the upper along at a portion of its circumferential length.

14. The article of footwear of claim 13 wherein the heel engaging component comprises a heel counter which is secured to the upper.

15. The article of footwear of claim 13 wherein the heel engaging component comprises a heel counter which is integrally formed with the upper.

16. The article of footwear of claim 13 wherein the insert member includes a cushioning material that is disposed over and around at least the second connector portion.

17. An article of footwear comprising:

a sole assembly;

an upper attached to the sole assembly, the upper including a heel engaging component with a first upper edge;

a first connector portion integrally formed with the heel engaging component and extending circumferentially along the first upper edge;

an insert member removably attached to the heel engaging component along its first upper edge, wherein the insert member includes a second connector portion and a second upper edge; and wherein the second connector portion extends circumferentially along the second upper edge of the insert member and corresponds with the first connector portion so that the insert member is attached to the heel engaging component of the upper along at a portion of its circumferential length;

wherein the insert member includes a cushioning material that is disposed over and around at least the second connector portion;

wherein the cushioning material further extends downwardly from the second connector portion and into a void defined by the upper, wherein the cushioning material is disposed in flush relationship with the heel engaging component of the upper.

18. The article of footwear of claim 17 wherein the first connector portion and the second connector portion extend circumferentially with one another so that the heel insert is attached to the upper along an entire circumferential length of the heel insert.

19. The article of footwear of claim 17 wherein the second connector portion is integrally formed with the heel insert.

20. An article of footwear comprising:

a sole assembly;

an upper attached to the sole assembly, the upper including a heel engaging component with a first upper edge;

a first connector portion integrally formed with the heel engaging component and extending circumferentially along the first upper edge;

an insert member removably attached to the heel engaging component along its first upper edge, wherein the insert member includes a second connector portion and a second upper edge; and wherein the second connector portion extends circumferentially along the second upper edge of the insert member and corresponds with the first connector portion so that the insert member is attached to the heel engaging component of the upper along at a portion of its circumferential length;

wherein the insert member includes a cushioning material that is disposed over and around at least the second connector portion;

wherein the cushioning material further extends downwardly from the second connector portion, over the heel engaging component of the upper, and onto a lower heel engaging area of the sole assembly.

21. The article of footwear of claim 20 wherein the first connector portion and the second connector portion extend circumferentially with one another so that the heel insert is attached to the upper along an entire circumferential length of the heel insert.

22. The article of footwear of claim 20 wherein the second connector portion is integrally formed with the heel insert.

23. An article of footwear having a heel insert assembly, the heel insert assembly comprising:

a sole assembly;

an upper attached to the sole assembly;

a heel counter secured to the upper, the heel counter having an upper edge which is an uppermost edge of the heel counter and including a first connector portion that is a male mechanical connector integrally formed therewith and extending circumferentially along the upper edge, wherein the heel counter is located inside the upper;

a heel insert removably attached to the heel counter along its upper edge, the heel insert including a corresponding second connector portion that is a female mechanical connector having portions that mate with the male mechanical connector by engaging both a surface of the male connector facing a forefoot portion of the article of footwear and engaging a surface of the male connector facing a heel of the article of footwear, and the heel insert including a cushioning material that is disposed over and around at least the second connector portion; and wherein the second connector portion mates and extends circumferentially with the first connector portion so that the heel insert is attached to the upper along its entire circumferential length.

24. The article of footwear of claim 23 wherein the male mechanical connector and the female mechanical connector engage one another in a snap-fit fashion.

25. The article of footwear of claim 23 wherein the male mechanical connector and the female mechanical connector extend circumferentially with one another so that the heel insert is attached to the upper along an entire circumferential length of the heel insert.

26. The article of footwear of claim 23 wherein the female mechanical connector is integrally formed with the heel insert.

* * * * *